US006280498B1

(12) United States Patent
Nozawa et al.

(10) Patent No.: US 6,280,498 B1
(45) Date of Patent: Aug. 28, 2001

(54) SYNTHETIC RESIN FUEL FOR MAKING IRON AND METHOD FOR MAKING IRON

(75) Inventors: Kentaro Nozawa; Yasuo Yoshida, both of Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/653,453

(22) Filed: Aug. 31, 2000

(30) Foreign Application Priority Data

Sep. 1, 1999 (JP) ..... 11-247891
May 11, 2000 (JP) ..... 12-138973

(51) Int. Cl.[7] ..... C21B 5/00
(52) U.S. Cl. ..... 75/304; 75/313; 75/459; 75/460; 75/471
(58) Field of Search ..... 75/313, 304, 471, 75/459, 460

(56) References Cited

U.S. PATENT DOCUMENTS 5,772,727 6/1998 De Haas et al. .
5,992,335 * 11/1999 Nakamura et al. ..... 75/459

FOREIGN PATENT DOCUMENTS 9-143526 6/1997 (JP) .
10-305430 11/1998 (JP) .
11-080763 3/1999 (JP) .

* cited by examiner

*Primary Examiner*—Melvyn Andrews
(74) *Attorney, Agent, or Firm*—Oblon, Spivak, McClelland, Maier & Neustadt, P.C.

(57) ABSTRACT

A synthetic resin fuel for stable production of pig iron in a blast furnace. It is in the form of cylindrical pellets, each measuring X mm in thickness and Y mm in diameter, with X and Y satisfying the three expressions of $3.0 \leqq X \leqq 10$, $2 \leqq Y \leqq 20$, and $Y/X \geqq 1.5$. The cylindrical pellets are produced by melting a resin, solidifying the melt, and cutting the solidified product. The cylindrical pellets should preferably contain more than 0.05 wt % of water. A process for producing pig iron in a blast furnace by blowing a synthetic resin fuel into a blast furnace through tuyeres, wherein said synthetic resin fuel is in the form of cylindrical pellets, each measuring X mm in thickness and Y mm in diameter, with X and Y satisfying the above-mentioned three expressions. The cylindrical pellets should preferably have a size distribution such that those having a diameter within ±20 % of the average diameter account for more than 70 wt %.

9 Claims, 6 Drawing Sheets

SYNTHETIC RESIN FUEL FOR MAKING IRON AND METHOD FOR MAKING IRON

BACKGROUND OF THE INVENTION

1. Field of the Invention:

The present invention relates to a synthetic resin fuel to be blown in through tuyeres for pig iron production in blast furnaces. The present invention relates also to a process for pig iron production with said synthetic resin fuel.

2. Description of the Related Art:

Blast furnaces need comparatively expensive coke for pig iron production. One way adopted to reduce coke consumption is to blow into tuyeres a variety of fuels such as natural gas, naphtha, heavy oil, tar, and pulverized coal.

There has recently been proposed a new technology of utilizing waste plastics material from the standpoint of waste disposal and recycling. For example, Japanese Patent Laid-open No. 143526/1997 discloses the use of a synthetic resin material having a specific surface area greater than 50 $m^2/kg$ for efficient combustion in blast furnaces.

For effective use of waste plastics material as a fuel, investigations are continuing an its shape and other factors that affect combustion efficiency and stable furnace operation.

Important factors for stable furnace operation include (1) the constant size of the raceway combustion zone, (2) the stable gas flow from the combustion zone, and (3) ability to be transferred over a long distance to tuyeres without clogging. Waste plastic material as a fuel is usually used in the form of agglomerated pellets having a large specific surface area for efficient combustion. In their half-molten state, such plastic pellets easily break during transfer or pressure-feeding to tuyeres. Broken pellets cause bridging in hoppers and clogging in pipes. In other words, they present difficulties in their long-distance transfer.

OBJECT AND SUMMARY OF THE INVENTION

The present invention was completed in view of the foregoing. It is an object of the present invention to provide a synthetic resin fuel for pig iron production by stable blast furnace operation. It is another object of the present invention to provide a process for producing pig iron with said synthetic resin fuel.

The first aspect of the present invention resides in a synthetic resin fuel for pig iron production in a blast furnace, said synthetic resin fuel being in the form of cylindrical pellets, each measuring X mm in thickness and Y mm in diameter, with X and Y satisfying the following three expressions.

$3.0 \leqq X \leqq 10$ $2 \leqq Y \leqq 20$ $Y/X \geqq 1.5$

The cylindrical pellets defined above are produced by melting a resin, solidifying the melt, and cutting the solidified product. The raw material of the resin may be crushed waste plastic material. The cylindrical pellets should preferably contain more than 0.05wt % of water.

The second aspect of the present invention resides in a process for producing pig iron in a blast furnace by blowing a synthetic resin fuel into a blast furnace through tuyeres, wherein said synthetic resin fuel is in the form of cylindrical pellets, each measuring X mm in thickness and Y mm in diameter, with X and Y satisfying the following three expressions.

$3.0 \leqq X \leqq 10$ $2 \leqq Y \leqq 20$ $Y/X \geqq 1.5$

The cylindrical pellets defined above are produced by melting a resin, solidifying the melt, and cutting the solidified product. The raw material of the resin may be crushed waste plastic material. The cylindrical pellets should preferably have a size distribution such that those having a diameter within ±20% of the average diameter account for more than 70 wt %. The cylindrical pellets should preferably contain more than 0.05 wt % of water.

DESCRIPTION OF THE PREFERRED EMBODIMENTS

The invention will be described with reference to four processes, each employing synthetic resin pellets prepared differently.

(1) Process employing pellets prepared from synthetic resin which has been melted once.

Figure 2:
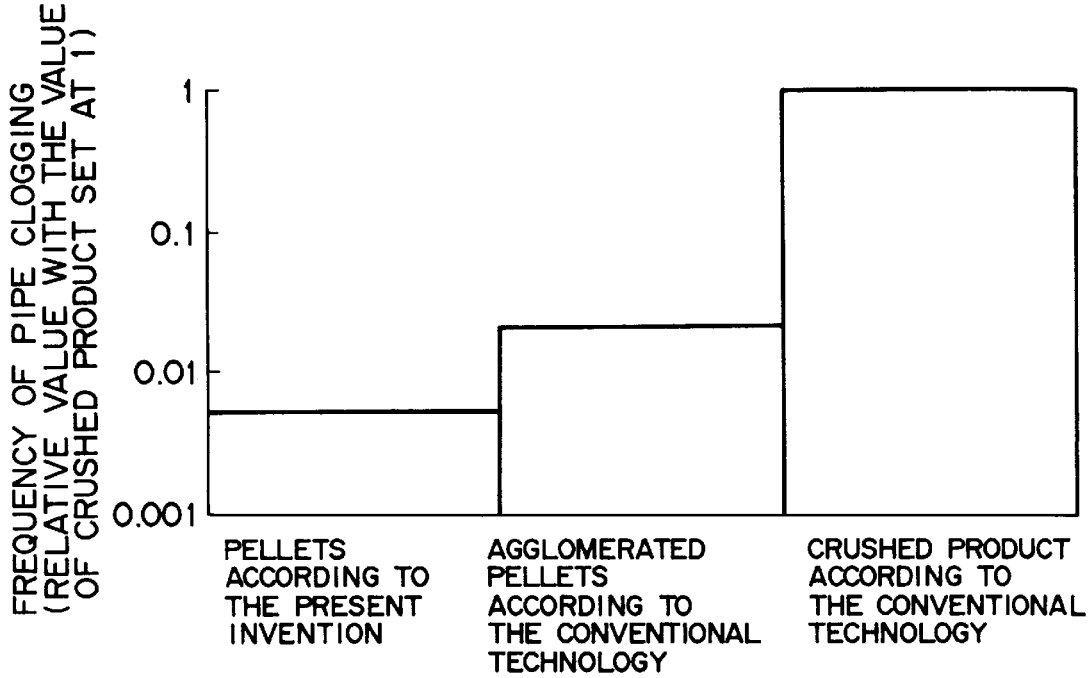
FIG. 2 is a graph showing the frequency of pipe clogging with synthetic resin pellets according to the present invention and the conventional technology.

FIG. 2 shows how the frequency of pipe clogging differs depending on the type of synthetic resin pellets employed. A process according to the present invention employed pellets which had been prepared by solidifying synthetic resin after melting it once. A process according to the conventional technology employed agglomerated pellets which had been prepared by half-melting synthetic resin and then solidifying it into blocks. Another process according to the conventional technology employed pellets which had been prepared by crushing synthetic resin. The ordinate in FIG. 2 represents relative values, with the result of crushed product set at 1.

Figure 3A:
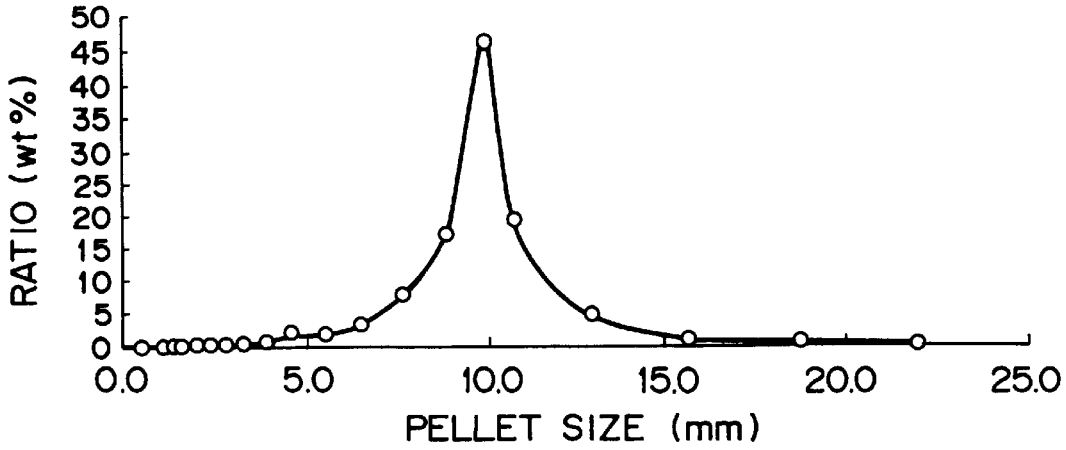
FIG. 3 is a graph showing the size distribution of synthetic resin pellets. Part (A) represents that of the pellets according to the present inventor. Part (B) represents that of agglomerated pellets according to the conventional technology. Part (C) represents that of crushed product according to the conventional technology.
Figure 3B:
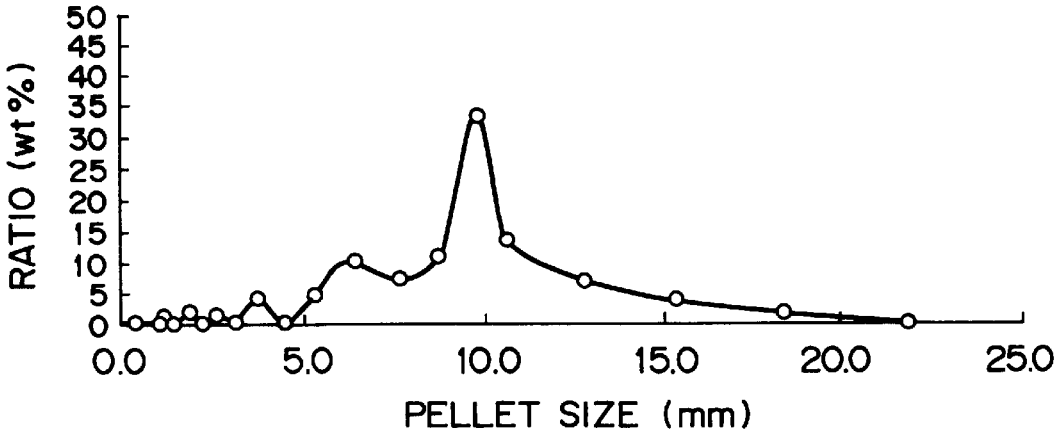
Figure 3C:
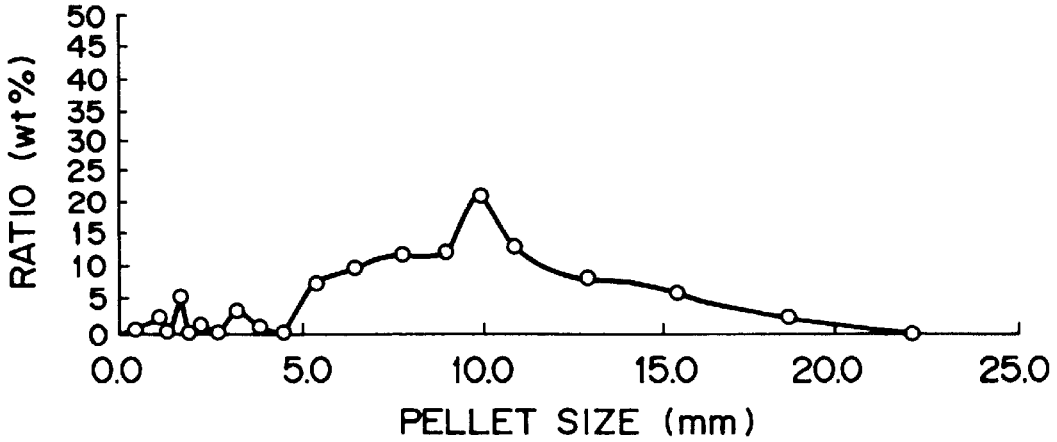

FIG. 3 is a graph showing the size distribution of synthetic resin pellets. Part (A) represents the pellets according to the present invention. These pellets have an average particle diameter of 9.6 mm, with a size distribution such that those of average diameter ±20% (7.7–11.6 mm) account for 85 wt %. Part (B) represents agglomerated pellets according to the conventional technology. These pellets have an average pellet diameter of 9.0 mm, with a size distribution such that those of average diameter ±20% (7.2–10.9 mm) account for 75 wt %. Part (C) represents crushed product according to the conventional technology. The crushed product has an average diameter of 9.5 mm, with a size distribution such that those of average diameter ±20% (6.8–10.2 mm) account for 43 wt %.

It is apparent from FIG. 2 that those pellets prepared by solidifying synthetic resin after melting it once are hardly broken during handling and are capable of long-distance pressure-transfer to tuyeres without pipe clogging. Pellets with such properties do not break but keep the size distribution after they have been blown into the furnace. This brings about a stable gas flow in the lower part of the furnace and hence contributes to stable furnace operation.

A detailed description is given below about the production of pellets from a synthetic resin which has been melted once. First, waste plastics material is crushed into small pieces, each smaller than about 30 mm. Crushed pieces are washed with water to remove foreign materials, such as high-melting plastics and metal and soil. High-melting plastics clogs the die at the forward end of the extruder and also abrades the screw of the extruder. Removal of metal and soil is effectively accomplished by water washing. The melting-granulator consists of a preheating and crushing machine, an extruder, and a pelletizer. After water washing for separation, wet plastics pieces are preheated (above 100° C.) and crushed and then fed to the extruder. The temperature of the feed is monitored by thermometers installed in the preheating and crushing machines. In the extruder, the plastic material is melted at a high temperature under a high pressure. The molten resin is extruded at a constant rate, with the die end temperature kept at about 280° C. The extrudate is cut into small pieces (pellets) which are immediately quenched in flowing water. It is possible to obtain pellets of different size by adjusting the rotary speed of the knife cutter of the pelletizer. It is possible to obtain cylindrical pellets by using a die having round holes. It is also possible to change the height (thickness) of the cylinder by adjusting the rotary speed of the knife cutter. In this way there are obtained resin pellets of desired size from the resin which has been melted once.

(2) Process employing cylindrical pellets prepared from a synthetic resin which has been melted and then solidified, each pellet measuring X mm in thickness and Y mm in diameter, with X and Y satisfying the following three expressions.

$3.0 \leqq X \leqq 10$ $2 \leqq Y \leqq 20$ $Y/X \geqq 1.5$

The advantage of this process, which is derived from using pellets prepared from synthetic resin which has been melted once, is that pellets are hardly broken during handling and hence are capable of long-distance pressure-transfer to tuyeres with lower possibilities of pipe clogging than agglomerated pellets. (FIG. 2)

The cylindrical pellets resembling discoid or thin plate effectively absorb radiation heat in all directions in the raceway despite their smaller specific surface area than agglomerated pellets. Therefore, they rapidly increase in temperature and gasify in the raceway. This contributes to their high burning rate.

The cylindrical pellets should have a thickness (X) of 1 mm to 10 mm. Those thicker than 10 mm are difficult to produce because of irregular cutting. Those thinner than 1 mm are so weak that they are readily broken when they are blown into tuyeres. (This is true particularly in the case where they contain a large amount of foreign matter.)

The cylindrical pellets of waste plastic material should have a diameter (Y) of 2 mm to 20 mm. Those exceeding 20 mm in diameter present difficulties in smooth cutting, and those smaller than 2 mm in diameter are extremely poor in extrudability and easily cause die clogging due to infusible foreign matter.

Figure 5:
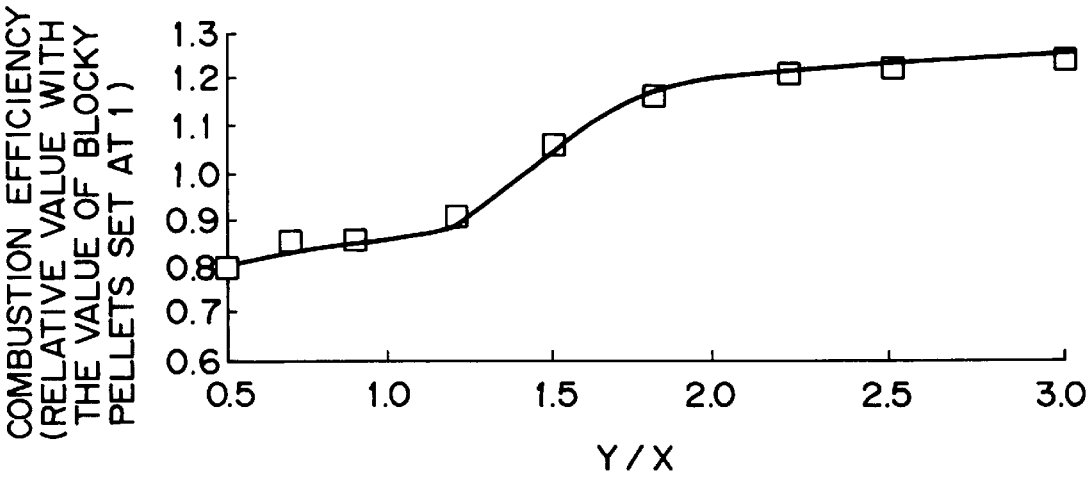
FIG. 5 is a graph showing the relation between the X/Y value and the combustion efficiency.

FIG. 5 is a graph showing how the value of Y/X is related to combustion efficiency. The ordinate represents the relative value, with the combustion efficiency of agglomerated pellets (according to the conventional technology) set at 1. For better combustion efficiency, the value of Y/X should preferably be greater than 1.5, more preferably greater than 1.8.

The results shown in FIG. 5 were obtained by experiments with pellets produced from waste plastics used for containers and packaging. The same process as (1) mentioned above was used for pellet production. The waste plastics consisted of plastics film (bags and wrapping film) and plastics bottles in a ratio of 1:1 by weight. In addition, the waste plastic materials were composed mainly of polyethylene, polystyrene, and polypropylene in a ratio of 42:33:25.

The results shown in FIG. 5 were obtained by experiments with pellets containing 0.1% water. This water content was achieved by centrifugal dehydration, which reduced the water content in waste plastics to 10%, and subsequent palletizing under specific conditions.

The above-mentioned experiments were carried out with those pellets which vary in thickness (X), with their diameter (Y) kept constant at 8.0 mm. The variation of thickness was such that those pellets having an average diameter ±20% account for about 80 wt % of the total amount. (The value of X is regarded as the average diameter.)

In addition, the above-mentioned experiments were carried out with an experimental coke-filled furnace (having a volume of 3.3 $m^3$) equipped with one tuyere, so that combustion efficiency was measured accurately. The efficiency of plastics combustion in front of the tuyere was estimated from the ratio of displacement which was calculated from the relation between the rate at which plastics was blown in and the rate at which the coke layer descended.

The preliminary experiments mentioned above were followed by feasibility tests with an actual furnace into which were blown 12 tons each of plastics pellets prepared under different conditions. The results are shown in Table 1.

TABLE 1

| Y/X (with Y constant at 8.0 mm) | 1.0 | 1.5 | 2.0 |
|---|---|---|---|
| Temperature fluctuation that occurred in bricks at the lower part of the furnace when pellets were blown in. | ±32° C. | ±20° C. | ±17° C. |

In addition, it was found that the ratio of Y/X affects the average temperature in stable operation. The average temperature at Y/X=1.0 was 10–40° C. higher than at Y/X=2.0. A probable reason for this is that when Y/X is 2.0, efficient combustion takes place in the raceway in front of the tuyere, coke moves down slowly to the raceway, and temperature at the lower part of the furnace increases (or the thermal mass flow ratio decreases). The results of the experiments with an experimental furnace were proved by the experiments with an actual furnace.

(3) Process employing pellets prepared from a synthetic resin which has been melted and then solidified such that the resulting pellets contain more than 0.05 wt % of water.

This process employs pellets which have been prepared by melting synthetic resin once. such pellets are hardly broken during handling and hence are less liable to pipe clogging than agglomerated pellets and permit long-distance pressure-transfer to tuyeres as mentioned above. (FIG. 2)

Figure 4:
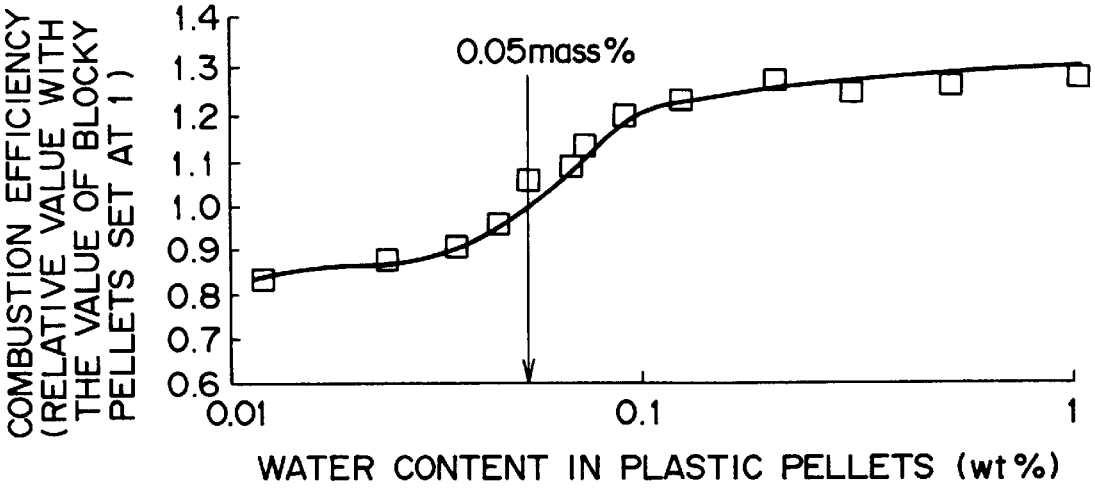
FIG. 4 is a graph showing the relation between the water content (wt %) in resin pellets and the combustion efficiency.

FIG. 4 is a graph showing how the water content (wt %) in resin pellets is related to combustion efficiency. The ordinate represents the relative value, with the combustion efficiency of agglomerated pellets (according to the conventional technology) set at 1. It is noted from FIG. 4 that those pellets containing more than 0.05 wt % of water rapidly increase in temperature and volume as they enter the raceway beyond the tuyere. Expanded pellets burn more efficiently than agglomerated pellets. Therefore, the water content in resin pellets should preferably be higher than 0.1 wt %.

The above-mentioned pellets are prepared from synthetic resin containing 0.5–20 wt % of water by melt-extrusion followed by cooling and cutting. They should preferably have fine holes on their cut surface. In the case of water content lower than 0.5 wt % before extrusion, the resulting pellets will not have sufficient holes. A synthetic resin containing more than 20 wt % of water will be poor in extrudability because of heat absorption by water.

Pellets having fine holes on their cut surface produce the same effect as agglomerated pellets because of their enlarged reaction surface area.

The same kind of resin and the same process for production of resin pellets were used in both experiments for FIG. 4 and FIG. 5. The resin pellets were cylindrical, 8 mm in diameter and 5 mm in thickness on average, and had a size distribution such that those having an average diameter ±20% account for 82–83 wt % of the total amount. The water content in resin pellets was controlled by changing the water content of the resin to be fed into the preheating and crushing apparatus and also adjusting the temperature in the preheating apparatus. During extrusion at a high temperature under a high pressure, water is enclosed in the extruder. As the extrudate is pelletized at the die end, water partly evaporates from the resin surface and partly remains in the resin which has rapidly solidified.

The experiment for FIG. 4 employed the same experimental furnace as used in the experiment for FIG. 5.

With the experimental results in FIG. 4 taken into account, a full-scale experiment with an actual furnace was carried out. Samples (5 tons each) of the above-mentioned shape containing 0.02 wt % and 0.12 wt % of water were prepared. Each sample was blown into an actual furnace equipped with one tuyere. Operation with the first sample resulted in a temperature fluctuation of ±30° C., whereas operation with the second sample resulted in a temperature fluctuation of ±18° C. This suggests that the adequate water content contributes to combustion efficiency as well as stable burning.

(4) Process employing pellets prepared from synthetic resin which has been melted and then solidified in such a way that the resulting pellets have a size distribution such that those having an average diameter ±20% account for more than 70 wt % of the total amount.

The size distribution of pellets (fuel) affects combustion in the blast furnace. In the raceway combustion zone which is formed beyond the tuyere, oxygen blown in by the blast is consumed by red-hot coke and fuel, with the generation of carbon dioxide gas and combustion heat. In the case of pellets having a greatly varied size distribution, the zone of oxygen consumption in the raceway expands toward the axis. As the result, the distribution of carbon dioxide concentration becomes broad, which makes unstable the position where high-temperature gas is generated in the raceway. Conversely, pellets with a small variation of size distribution contribute to a stable position for generation of high-temperature gas in the raceway, which leads to a smaller temperature fluctuation in the lower part of the furnace.

Figure 1:
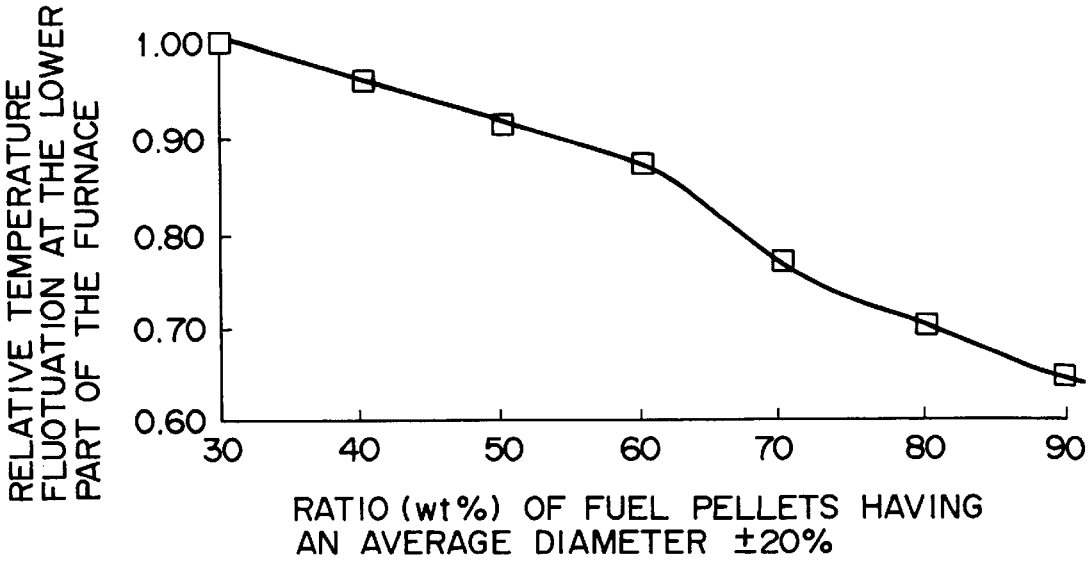
FIG. 1 is a graph showing the relation between the ratio (by weight) of synthetic resin pellets contained in those having a diameter within ±20% of the average diameter and the temperature fluctuation in the lower part of the furnace.

FIG. 1 is a graph showing how the temperature fluctuation in the lower part of the furnace varies depending on the ratio of pellets having an average diameter ±20%. The ordinate in FIG. 1 represents the relative value of temperature fluctuation, with the reference value (1.00) being the temperature fluctuation in the case of pellets having a size distribution such that those having an average diameter ±20% account for 30 wt % of the total amount. It is noted from FIG. 1 that the gas flow in the lower part of the furnace varies with the change in the ratio of pellets having a diameter within ±20% of the average diameter. Those pellets with a ratio greater than 70% contributed to remarkable improvement in the gas flow in the lower part of the furnace. The ratio of pellets having a diameter within ±20% of the average diameter should preferably be greater than 80%, more preferably greater than 90%.

The same kind of resin and the same process for production of resin pellets were used in both experiments for FIG. 1 and FIG. 5. The experiment for FIG. 1 employed pellets whose size distribution was controlled by running the pelletizer at different rotary speeds (low, medium, and high) for periodically changing lengths of time. To be concrete, the pelletizer was continuously run for 8 hours at three different speeds which were periodically switched at intervals of 30 minutes. One batch weighing 5 tons of pellets with a known size distribution was blown into the blast furnace, and the temperature of bricks in the lower part of the furnace was examined for fluctuation. A series of experiments were conducted with other batches varying in size distribution. These experiments employed resin pellets having a fixed diameter of about 5 mm, with the thickness varied in the range of 1 to 10 mm.

The following example demonstrates the above-mentioned process.

Resin pellets of different type were prepared in the following manner from synthetic resin raw materials, one in film form and the other in solid form.

(1) Pellets pertaining to the present invention were prepared from the raw material by melting, solidifying, and cutting.

(2) Agglomerated pellets for comparison were prepared according to the method disclosed in Japanese PCT publication No. 507105/1996.

(3) Crushed product for comparison was prepared by crushing the raw material by a high-speed crusher.

Each batch of pellets (or crushed product) was classified by screening, and the result of classification is shown in Table 2.

TABLE 2

| Sample designation | Shape of raw material | Typical pellet diameter (mm) 10.12 | 8.725 | 7.33 | 6.195 | 5.31 | 4.48 | 3.40 | 2.40 | 1.50 | 9.75 | 0.25 |
|---|---|---|---|---|---|---|---|---|---|---|---|---|
| Pellets (1) * | Film | 0.0 | 0.2 | 1.4 | 62.8 | 33.9 | 1.7 | 0.0 | 0.0 | 0.0 | 0.0 | 0.0 |
| Pellets (2) * | Solid | 0.0 | 0.0 | 8.9 | 15.1 | 12.8 | 0.2 | 2.9 | 0.0 | 0.0 | 0.0 | 0.0 |
| Agglomerated pellets (1) | Film | 5.1 | 10.0 | 34.2 | 37.3 | 11.5 | 0.8 | 0.6 | 0.2 | 0.2 | 0.1 | 0.1 |
| Agglomerated pellets (2) | Solid | 0.0 | 0.6 | 3.5 | 17.8 | 26.1 | 22.6 | 23.7 | 4.1 | 1.4 | 0.1 | 0.1 |
| Crushed product (1) | Film | 4.8 | 37.6 | 24.4 | 9.7 | 8.0 | 6.2 | 6.2 | 1.8 | 4.2 | 0.1 | 0.2 |
| Crushed product (2) | Solid | 0.0 | 7.4 | 22.7 | 22.9 | 16.5 | 14.5 | 13.8 | 1.5 | 0.4 | 0.0 | 0.2 |

| Sample designation | Average diameter (mm) | Diameter of average minus 20% (mm) | Diameter of average plus 20% (mm) | Ratio of pellets with diameter of average ±20% (wt %) | Average ratio (wt %) ** |
|---|---|---|---|---|---|
| Pellets (1) * | 5.9 | 4.7 | 7.1 | 97.5 | 94.8 |
| Pellets (2) * | 6.1 | 4.9 | 7.3 | 92.2 | |
| Agglomerated pellets (1) | 6.9 | 5.5 | 8.3 | 76.1 | 64.7 |
| Agglomerated pellets (2) | 4.7 | 3.8 | 5.7 | 53.3 | |
| Crushed product (1) | 7.1 | 5.7 | 8.5 | 48.2 | 48.2 |
| Crushed product (2) | 5.8 | 4.6 | 6.9 | 48.2 | |

* Prepared according to the invention.
** The average value of "the ratio (by weight) of pellets having a diameter within ±20% of average diameter" for pellets prepared from film and solid raw materials.

Figure 6:
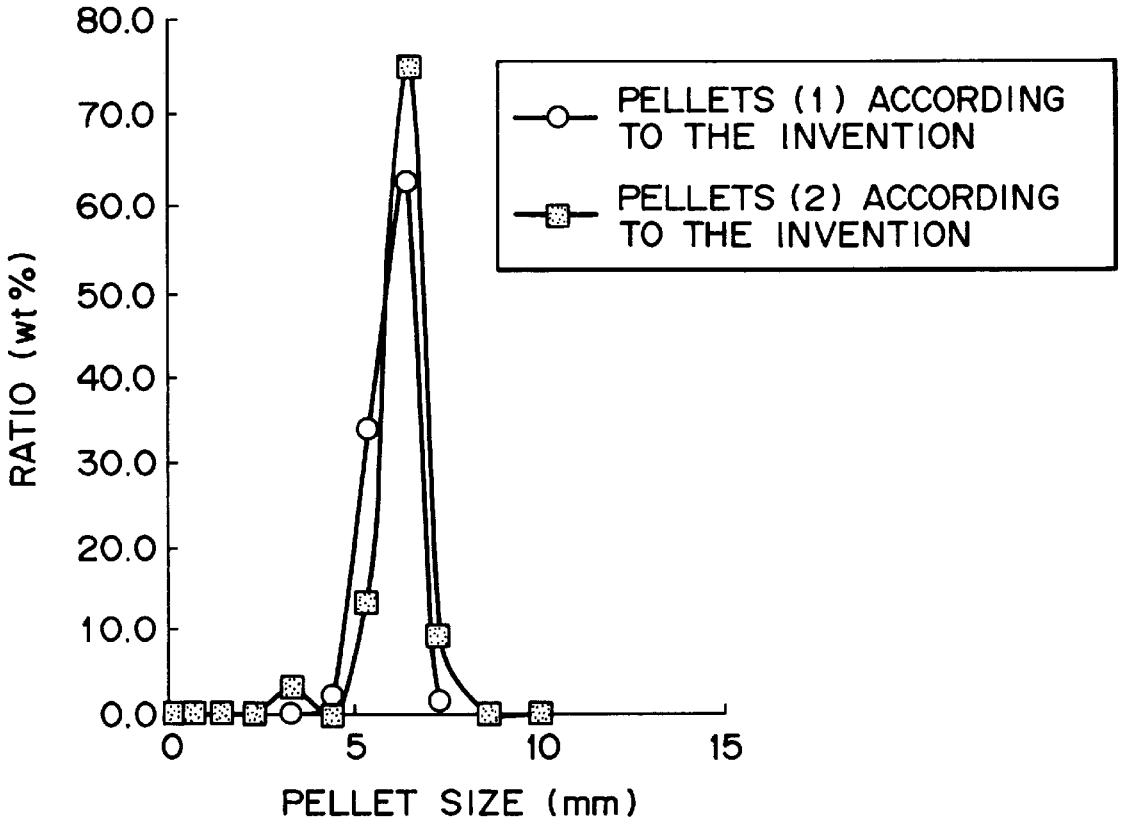
FIG. 6 is a graph showing the size distribution of pellets according to the invention in Examples.
Figure 7:
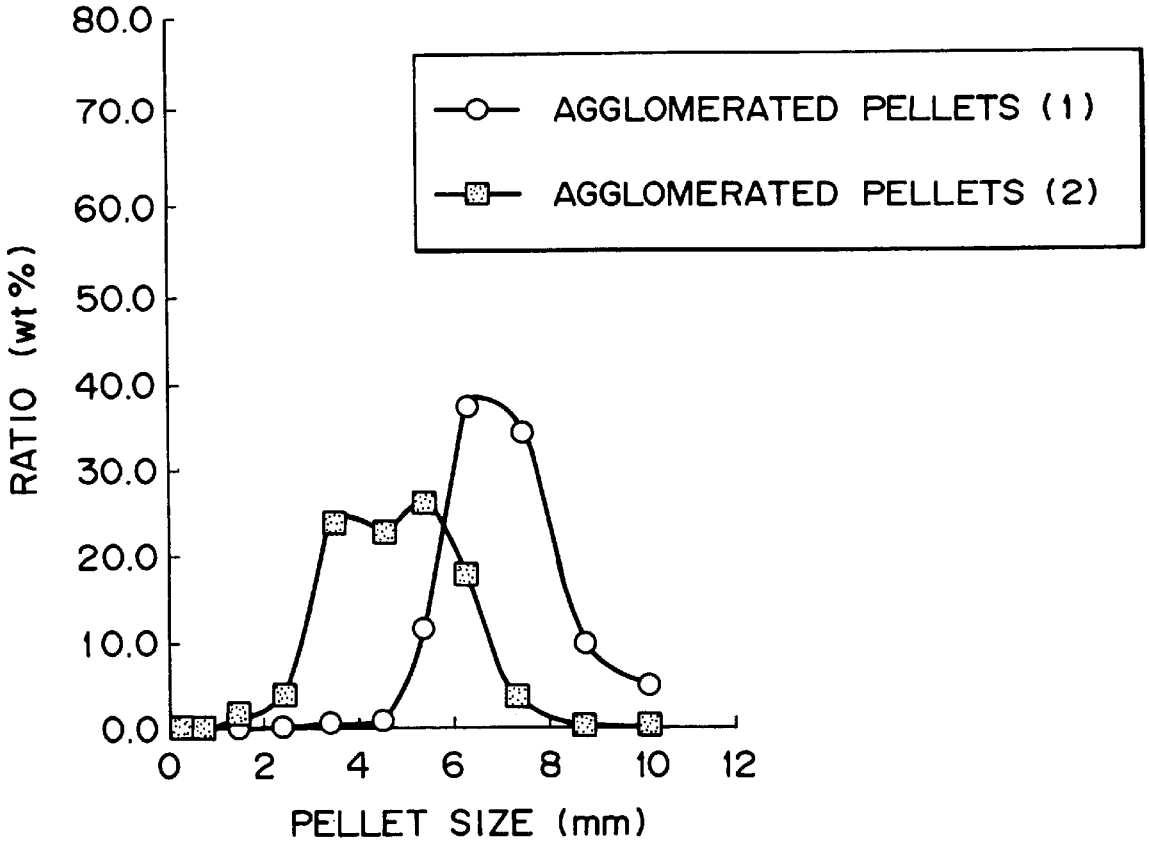
FIG. 7 is a graph showing the size distribution of agglomerated pellets in Examples.
Figure 8:
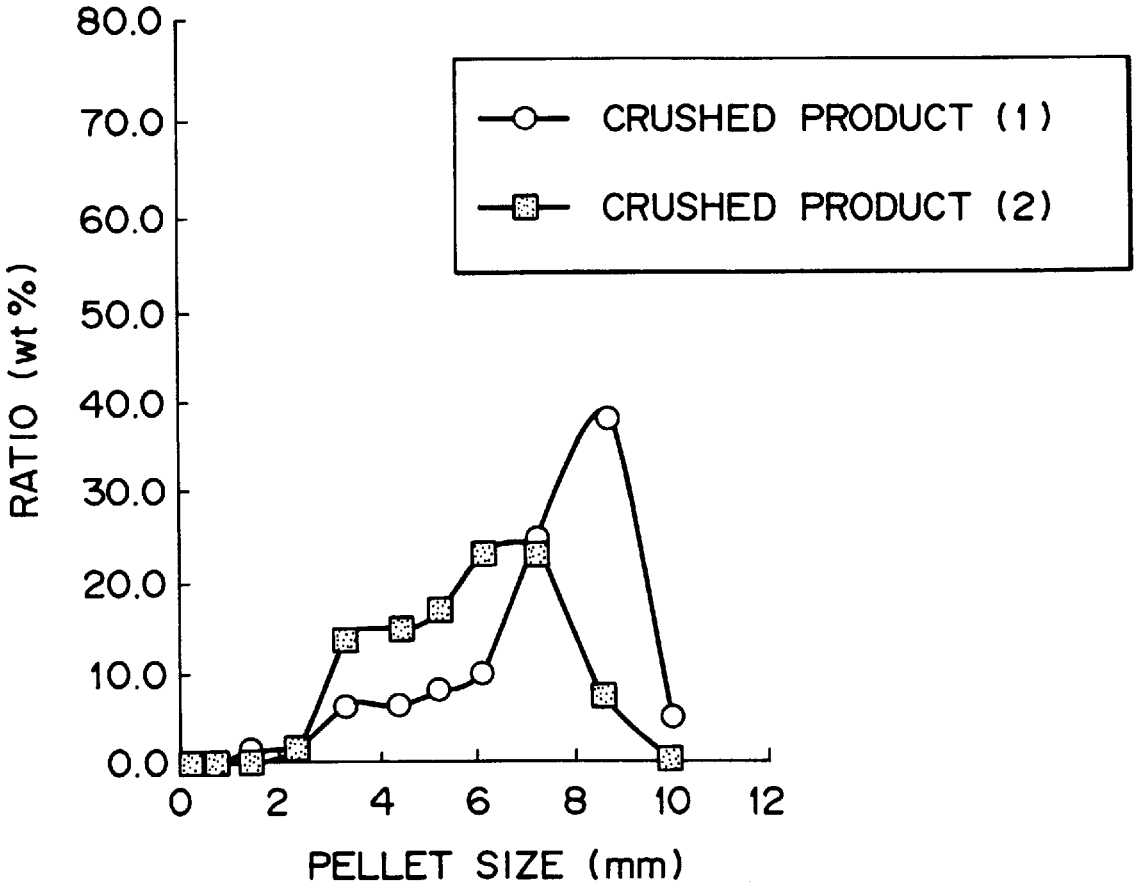
FIG. 8 is a graph showing the size distribution of crushed product in Examples.

FIGS. 6 to 8 show the size distribution of each kind of pellets (or crushed product) compiled from the data in Table 2. It is noted from FIGS. 6 to 8 that agglomerated pellets and crushed products had a broad size distribution or they are not uniform in shape. By contrast, the pellets according to the present invention were uniform in shape regardless of the shape of raw material. Therefore, they permitted long-distance transfer to tuyeres without pipe clogging and they also permit stable combustion in the blast furnace.

Now, it has been demonstrated that the above-mentioned four methods (1) to (4) make it possible to blow synthetic resin into the blast furnace while keeping its stable operation. The combination of these methods will contribute further to the stable operation of the blast furnace.

What is claimed is:

1. A synthetic resin fuel for pig iron production in a blast furnace, said synthetic resin fuel being in the form of cylindrical pellets, each measuring X mm in thickness and Y mm in diameter, with X and Y satisfying the following three expressions.

$3.0 \leqq X \leqq 10$ $2 \leqq Y \leqq 20$ $Y/X \geqq 1.5$.

2. The synthetic resin fuel for pig iron production in a blast furnace as defined in claim 1, wherein said cylindrical pellets are produced by melting a resin, solidifying the melt, and cutting the solidified product.

3. The synthetic resin fuel for pig iron production in a blast furnace as defined in claim 1, wherein said cylindrical pellets are produced by crushing and melting waste plastics material, solidifying the melt, and cutting the solidified product.

4. The synthetic resin fuel for pig iron production in a blast furnace as defined in any of claims 1 to 3, wherein said cylindrical pellets contain more than 0.05 wt % of water.

5. A process for producing pig iron in a blast furnace by blowing a synthetic resin fuel into a blast furnace through tuyeres, wherein said synthetic resin fuel is in the form of cylindrical pellets, each measuring X mm in thickness and Y mm in diameter, with X and Y satisfying the following three expressions.

$3.0 \leqq X \leqq 10$ $2 \leqq Y \leqq 20$ $Y/X \geqq 1.5$.

6. The process for producing pig iron in a blast furnace as defined in claim 5, wherein said cylindrical pellets are produced by melting a resin, solidifying the melt, and cutting the solidified product.

7. The process for producing pig iron in a blast furnace as defined in claim 5, wherein said cylindrical pellets are produced by crushing and melting waste plastics material, solidifying the melt, and cutting the solidified product.

8. The process for producing pig iron in a blast furnace as defined in any of claims 5 to 7, wherein said cylindrical pellets have a size distribution such that those having a diameter within ±20% of the average diameter account for more than 70 wt %.

9. The process for producing pig iron in a blast furnace as defined in any of claims 5 to 7, wherein said cylindrical pellets contain more than 0.05 wt % of water.

* * * * *

UNITED STATES PATENT AND TRADEMARK OFFICE

CERTIFICATE OF CORRECTION

PATENT NO. : 6,280,498 B1
DATED : August 28, 2001
INVENTOR(S) : Nozawa et al.

It is certified that error appears in the above-identified patent and that said Letters Patent is hereby corrected as shown below:

Title page,
Item [73], Assignee's information should read:
-- [73] Assignee: Kabushiki Kaisha Kobe Seiko Sho
(Kobe Steel Ltd.) Kobe-shi (JP) --

Signed and Sealed this

Twenty-third Day of April, 2002

*Attest:*

*Attesting Officer*

JAMES E. ROGAN
*Director of the United States Patent and Trademark Office*